United States Patent [19]

Champion et al.

[11] 3,960,694

[45] June 1, 1976

[54] NOVEL ANODE ADJUSTMENT APPARATUS

[75] Inventors: Fred Champion, Pine Hill; Thomas W. Kern, Fairhope, both of Ala.

[73] Assignee: Olin Corporation, New Haven, Conn.

[22] Filed: Nov. 8, 1974

[21] Appl. No.: 522,403

[52] U.S. Cl. ..... 204/219; 204/225

[51] Int. Cl.[2] ..... C01D 1/14

[58] Field of Search ..... 204/219, 225, 250

[56] References Cited

UNITED STATES PATENTS

| | | | |
|---|---|---|---|
| 2,617,762 | 11/1952 | Basilewsky | 204/225 |
| 3,140,991 | 7/1964 | Gardiner | 204/225 |
| 3,390,070 | 6/1968 | Cooper et al. | 204/219 |
| 3,574,073 | 4/1971 | Ralston, Jr. | 204/219 |

*Primary Examiner*—T. M. Tufariello

*Attorney, Agent, or Firm*—Donald F. Clements; T. P. O'Day; James B. Haglind

[57] ABSTRACT

An improved anode adjustment means for mercury cells is disclosed in which a plurality of worm gears are employed to adjust the height of a plurality of anodes attached to arms secured to a central anode support member which is operated by the plurality of worm gear apparatus. Utilization of this novel worm gear apparatus eliminates the need for individual adjustment of each anode in the cell and thereby minimizes the overall operating costs.

6 Claims, 3 Drawing Figures

NOVEL ANODE ADJUSTMENT APPARATUS

This invention relates to a novel anode adjustment means for mercury cells.

In mercury cathode electrolytic cells, the distance between the anode and the mercury cathode is very important. This interelectrode distance should be as small as possible to reduce the wasteful consumption of energy, for example, in the production of heat. However, if this distance is too small, secondary reactions take place, particularly the direct attack on sodium amalgam by chlorine bubbles. This interelectrode distance is ordinarily maintained, if possible, in the range of from about 1/32 to about ¼ inch and preferably from about one-eighth to about three-sixteenths of an inch when the anodes are graphite. When the anodes are metallic, closer distances between the anode and cathode can be employed.

Numerous techniques have been suggested for the adjustment of this interelectrode distance. U.S. Pat. No. 3,390,070, issued June 25, 1968, to R. M. Copper et al discloses a technique which employs a chain driven sprocket to raise and lower the anodes in a particular group. U.S. Pat. No. 3,574,073, which issued Apr. 6, 1971, to R. W. Ralston, Jr., also utilizes a chain driven sprocket to raise and lower the anodes, in combination with a technique for controlling the interelectrode distance with an electric circuit which is responsive to changes in the flux of the magnetic field generated by electrical flow in a conductor supplying circuit to the anodes. In each of these techniques, normally only a portion of the anodes in a given cell are adjusted by the chain driven sprocket since there is a limit to how many sprockets can be employed and a limit to the length of chain that can be used successfully to raise and lower the anodes.

In Japanese Patent 23309/1961, an anode adjustment apparatus is disclosed which utilizes a motor driven worm which operates on two worm gears. One worm gear raises an anode support arm on one side of the cell and an oppositely threaded worm gear raises an anode support arm on the other side of the cell. This technique will make it difficult to uniformly raise the anodes in a single cell unless each side is properly adjusted. In addition, there is a difficulty in the interchange of worm gears since half of the worm gears are threaded in one direction and the other half are threaded in the opposite direction. Interchange of these threaded worm gears by inexperienced plant personnel can cause severe damage to the parts as well as loss of production.

Belgium Patent 682262 discloses an anode adjustment apparatus which employs a worm gear technique for adjusting the anode height, but in this apparatus a worm gear is employed for each anode post. This is an expensive apparatus since the worm gear and worm is utilized on each anode post, but adjustment is accomplished from a single motor driven apparatus. Thus, all of the anode posts are raised or lowered at the same time, but the expense of a worm and worm gear for each anode post is necessary to accomplish this.

There is a need at the present time for an improved anode adjustment apparatus employing a more direct mechanical technique such as a worm-worm gear operation, with a minimum of worm gears per cell.

It is an object of this invention to provide an improved anode adjustment apparatus for mercury cathode electrolytic cells.

It is a further object of this invention to reduce the cost of anode adjustment apparatus in mercury cathode electrolytic cells.

These and other objects of the invention will appear from the following detailed description of the invention.

It has now been discovered that the foregoing objects are accomplished in a mercury cathode electrolytic cell comprised of a cell body, a cell cover, anodes positioned above the cathode having anode posts secured to the top thereof, which extend through openings in the cell cover and an anode adjustment means operating upon the anode posts to adjust the interelectrode distance, wherein an improved anode adjustment means is used comprised of:

a. a central base member secured to the top of the cell cover,
b. at least two upright threaded posts having the bottoms of each secured at spaced intervals to the top of the central base member,
c. a worm gear adjuster secured to the top of each of said threaded posts, said adjuster being comprised of:
   1. a housing secured to the central anode support member,
   2. a worm gear having a threaded opening in the center adapted to rotate about the top of the threaded posts,
   3. a threaded worm adapted to mesh with threads on the circumference of the worm gear,
   4. a rod secured to and joining each of said threaded worms,
   5. anode arms secured at spaced intervals along said central anode support member,
   6. a plurality of anodes secured to opposite sides of the anode arms,
   7. a means for rotating the rod, whereby said threaded worms are rotated, the worm gears are rotated, and the central anode support member, the anode arms and all of the anodes secured to the anode arms are raised or lowered in the direction of movement of the worm gear on the threaded posts.

Figure 1:
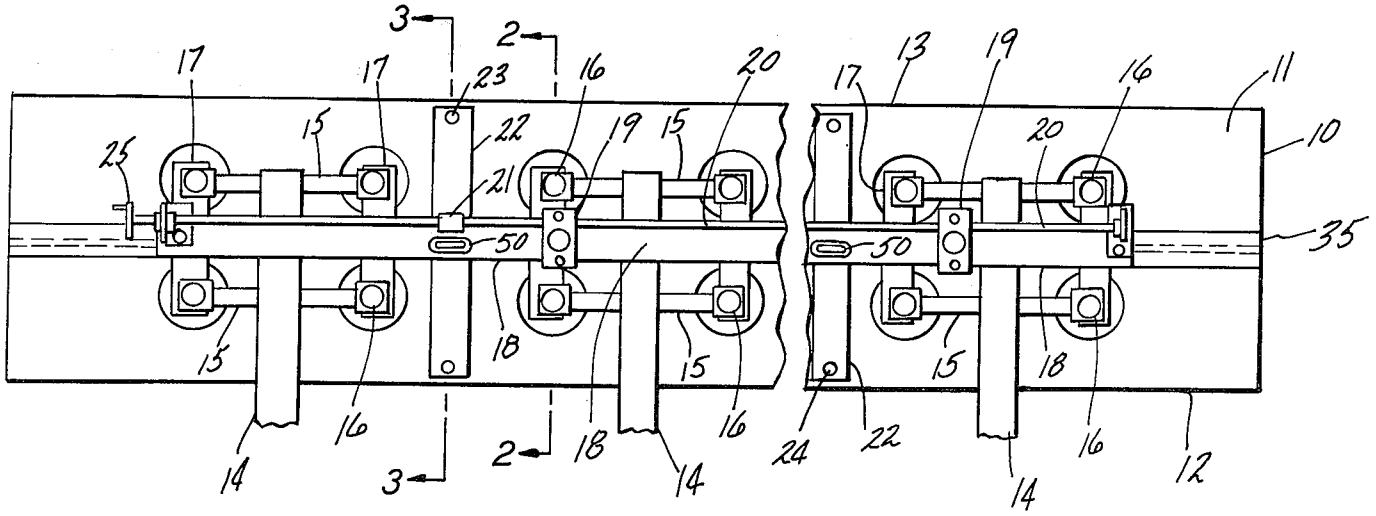
FIG. 1 is a top view of a mercury cathode electrolytic cell showing the novel anode adjustment apparatus of this invention.

In FIG. 1, cell 10 is shown having cell cover 11 positioned and secured to opposite cell sides 12 and 13. Bus bar 14 conveys current from the plant supply above cell cover 11 to anode post distributors 15, which are secured to anode posts 16.

Anode support arms 17 are secured to anode posts 16 at the top thereof, and they are also secured in the center to the underside of central anode support member 18. Central anode support member 18 is positioned above cell cover 11 in approximately the center thereof, and substantially parallel to opposite sides 12 and 13. Secured to the top of central anode support member 18 is at least two worm gear assemblies 19, positioned at opposite ends, preferably, of central anode support member 18. The threaded worms in each worm gear assembly 19 are connected by means of rods 20 which may be a plurality of separate rods connected by coupling 21.

Also, positioned under central anode support member 18 at spaced apart intervals are stiffening members 22 which are positioned perpendicular to the central anode support member 18. The stiffening member 22 is secured to support posts 23 and 24 which are positioned on opposite sides of cell cover 11.

A suitable handle or motor driven means 25 is secured to one end of rod 20 in order to impart motion and movement to the worm gears.

Figure 2:
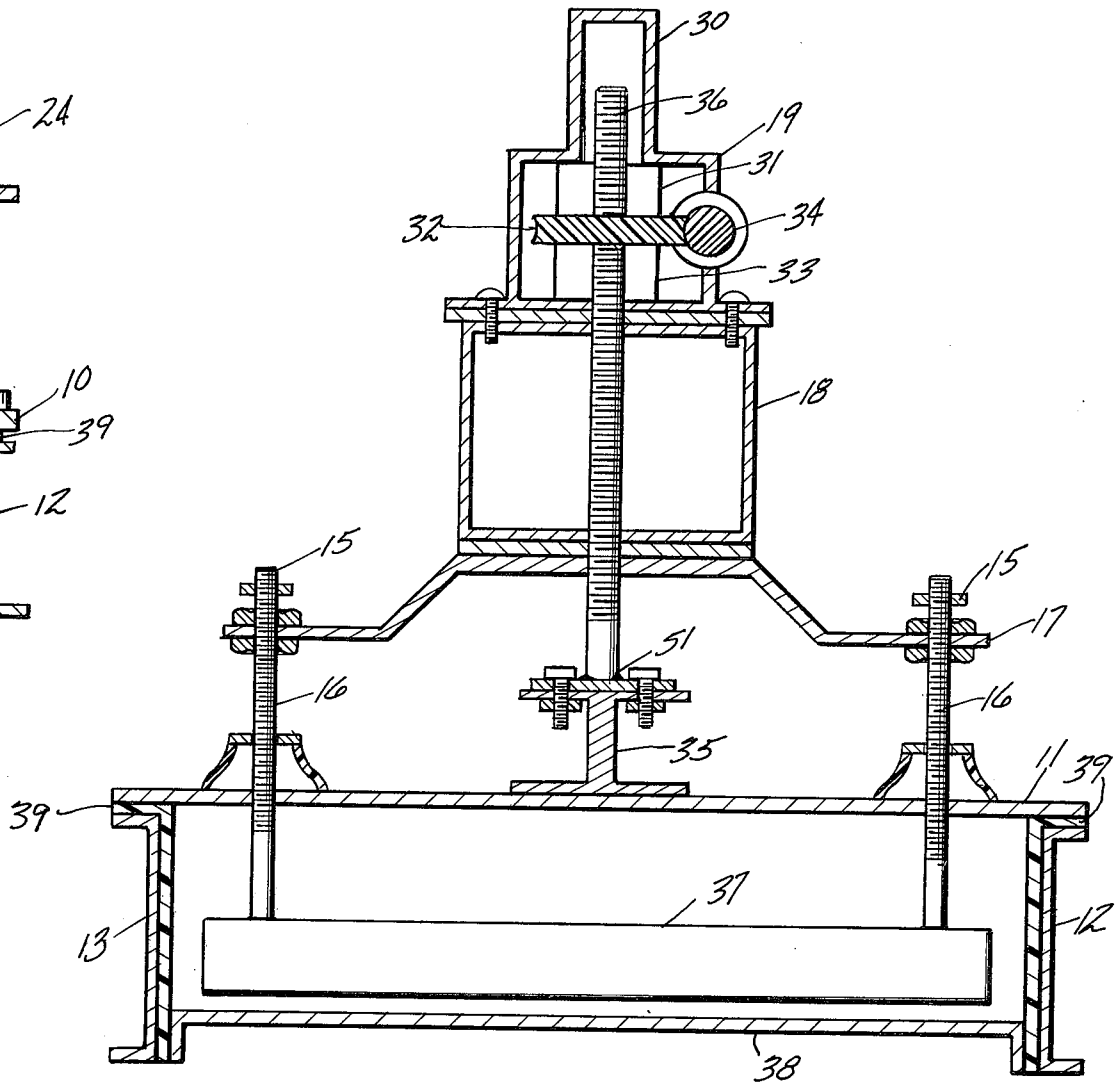
FIG. 2 is a sectional elevational view of the mercury cathode electrolytic cell of FIG. 1 through lines 2—2 of FIG. 1.
Figure 3:
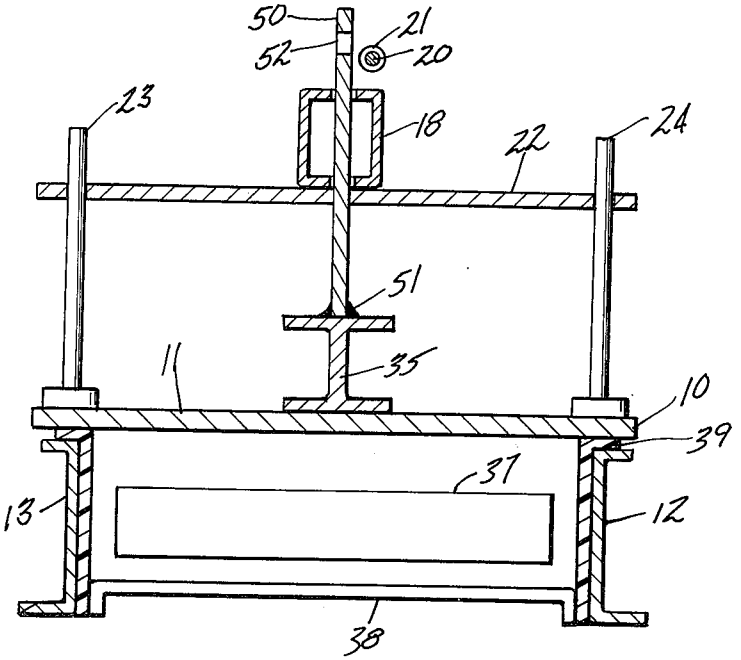
FIG. 3 is a sectional elevational view of the mercury cathode electrolytic cell of FIG. 1 through lines 3—3 of FIG. 1.

FIGS. 2 and 3 show sectional elevational views of the cell 10 of FIG. 1 through lines 2—2 and lines 3—3, respectively, using the same numbers to identify the same components of the cell.

FIG. 2 is a cross sectional elevational view of FIG. 1 through the worm gear assembly 19. Worm gear assembly 19 is comprised of an exterior housing 30 which contains an upper bushing 31 secured to the top of threaded worm gear 32. Positioned below threaded worm gear is lower bushing 33. Threaded worm 34 is adapted to mesh with the threads on the circumference of threaded worm gear 32 so that when threaded worm 32 is rotated, it will rotate threaded worm gear 32 and move upper bushing 31 against housing 30 or move lower bushing 33 against the lower portion of housing 30 which is secured to central anode support member 18.

A central base member 35 is secured to the top of cell cover 11 beneath and spaced apart from, but substantially parallel to central anode support member 18. Secured to the top of central base member 35 is a plurality of threaded upright members 36, which are preferably spaced apart and positioned on the top of central base member 35.

A central opening is provided in upper bushing 31 and lower bushing 33 as well as threaded worm gear 32 which meshes with and operates on the upper portion of threaded upright member 36.

The lower ends of anode posts 16 are secured to anodes 37, which are positioned above cell base 38 out of contact with the mercury cathode (not shown) which moves on the upper portion of the cell base 38.

The cell sides are preferably lined with a corrosion resistant material such as rubber 39.

FIG. 3 is a sectional elevational view showing stiffening member 32 as well as lifting member 50. The lower portion of lifting member 50 is secured by welding 51 or the like to the upper portion central base member 35. The upper end of lifting member 50 is provided with a lifting opening 52, which is employed when anodes must be replaced in the lifting of the entire cell tops and anode assembly from the cell. A crane hook (not shown) is inserted in lifting opening 50 for raising and lowering the anode unit of cell 10.

It can be seen from sectional elevational views that central cell base member 35 may be in the form of an I-beam and central anode support member 18 in the form of square tubing, but other suitable shapes can be used for these members, if desired.

In carrying out the operation of the novel anode adjustment system of this invention, the size of the threaded worm gear 32 and threaded worm 34 are selected to provide a known movement of the anodes during a single revolution of threaded worm 34. For example, when threaded worm gear 32 has an outside diameter of about 6¼ inches with 50 teeth, threaded worm 34 has a pitch diameter of 1½ inches and threaded upright member 36 has an outside diameter of about one inch with 5 threads per inch. A single revolution of threaded worm 34 is capable of moving the anodes a distance of about 0.004 inches. A typical anode wear rate for graphite anodes in a mercury cathode electrolytic cell ranges from about 0.005 to about 0.010 inches per day and thus, one or two revolutions of the threaded worm 34 will lower the anodes a sufficient distance to maintain the optimum voltage across the cell. Generally, the optimum gap ranges from about one thirty-seconds to about ¼ inch, and preferably from about one-eighth to about three-sixteenths of an inch between the bottom of the graphite anodes and the top of the mercury cathode.

The optimum gap is generally determined by connecting a suitable voltage meter across the cell, and carefully lowering the anodes until a minimum voltage is obtained without achieving a short circuit by contact of the anode with the mercury cathode. Raising the anodes slightly from the point where a marked decrease in voltage occurs, as the anode is lowered toward the cathode, will be the optimum operating condition. As production continues, there will be a gradual wearing away of the anode, and adjustment of the anodes in a given cell should be made periodically in the same manner. Generally once a day is sufficient.

The number and location of worm gear assemblies 19 and threaded up-right members 36 will depend upon the length of central anode support member 18 and the number and size of anodes 37 that are secured through anode support arms 17 to central anode support member 18. The threaded upright members 36 are positioned on central base member 35 to result in minimum deflection of central anode support member 18. For example, in a mercury cathode electrolytic cell 10 having a length of about 34 feet and a central anode support member 18 of about 32 feet, four threaded upright members 36 and accompanying worm gear assemblies 19 were employed. Two of the threaded upright members 18 were positioned about four feet from each end of central anode support member 18 and the other two threaded upright members 18 were positioned between the first two threaded upright members 18 about 8 feet apart from each other and about 8 feet from one of the first two threaded upright members 18. The location of auxiliary equipment on cell 10, such as bus bars, anode posts and the like may require slight adjustment in the position of threaded upright members 18.

A suitable worm gear assembly 19 is a commercial screw jack assembly of the worm gear actuated type having a 2 ton capacity with a 10 inch travel and an 8:1 gear ratio with an inverted threaded end. The threaded upright member has a 1 inch diameter and one turn of the worm will raise the unit one thirty-seconds of an inch.

The number of threaded upright member 18 is at least two and is generally two for the first 10 foot of length of central anode support member 18, with one additional threaded upright member 18 for each additional 10 foot of length thereof.

Similarly, the number and location of lifting members 50 are employed that will result in a relatively level position and substantially equal distribution of load when the anode unit is lifted out of cell 10 for anode replacement or other reasons.

Anode support arms 17 are shown in FIGS. 1 and 2 as a continuous unit attached to the bottom of central anode support member 18. If desired, two separate pieces of angle metal may be employed as the anode support arm 17 with one leg of one piece of angle being secured to the side of central anode support member 18 and the other leg of one piece of angle being secured to the top of anode post 16 on that side of central support member 18. The other piece of angle is secured to the opposite side of central anode support member 18 and the anode posts 16 on that side of central anode support member 18. Any other convenient means for securing the anode posts 16 to anode support arms 17 and to central anode support member 18 may be employed.

In one embodiment of the invention, stiffening member 22 and support posts 23 and 24 can be eliminated since the concentric balance achieved by having one series of anode posts 16 secured on one side and another series of anode posts 16 on the opposite side of central anode support member 18 is generally adequate to keep the entire anode unit from tilting. However, if tilting of the anode unit is a problem, stiffening member 22 and accompanying support posts 23 and 24 may be employed.

When the novel anode adjustment apparatus of this invention is employed, closer control of the interelectrode gap is achieved and thus there is a marked saving in energy consumption. In addition, when graphite anodes are employed, there is a substantial reduction in the wear rate since all of the anodes on one cell are raised and lowered at the same time and a more even adjustment results. Under previous conditions it was necessary to make individual adjustment of anode posts and frequently the improper adjustment of one post would cause tilting of the anode which resulted in uneven wear of the anodes.

The following example is presented to define the invention more fully without any intention of being limited thereby. All parts and percentages are by weight unless otherwise specified.

EXAMPLE

A bank of mercury cathode cells of the type described in Industrial and Engineering Chemistry, September, 1953, pgs. 1824–1835, volume 45, no. 9, were fitted with the worm gear assemblies shown in FIGS. 1, 2, and 3 to adjust the interelectrode gap. Each cell was approximately 34 feet long, two feet wide and fitted with 22 graphite electrodes placed in a single line, each anode having two anode posts 16 secured to anode support arm 17.

Using the worm gear assemblies 19, accompanying threaded upright members 18 and auxiliary equipment of FIGS. 1–3, four threaded upright members 18 were secured to the top of central cell base member 18, which was a wide flange I-beam having a height of 4 inches, a length of 34 feet and a weight of 13 pounds per foot.

Each threaded upright member 18 had a diameter of 1 inch. These threaded upright members were spaced apart approximately equidistant along the top of central cell base member 18.

Worm gear housings 19 were meshed on the top of each threaded upright member 18. The bottom of each worm gear housing 19 was secured to the top of central anode support member 18 was a length of square structural tubing having a length of about 32 feet 7 inches, a width of 4 inches and a thickness of about ⅜ inch. The first worm gear housing 19 nearest the feed end of the cell has about 3 feet 8 inches from the end of central anode support member 18. The second worm gear housing 19 was about 7 feet from the first, the third was about 9 feet from the second, and the fourth was about 8 feet from the third housing 19.

Commercial screw jacks of the worm gear actuator type, having a 10 inch travel and a 2 ton capacity with an 8:1 gear ratio with an inverted threaded end were used as the worm gear housing 19.

In carrying out cell operation under conventional conditions other than the use of the worm gear assembly 19 of this invention, the cell was operated at a cell voltage of approximately 3.9 to 4.1, adjusting the anodes by means of worm gear assembly 19, only once every 24 hours on the average.

In contrast, when no worm gear assemblies were employed, there were 44 separate anode adjustments required per cell consuming considerable time. In addition, the average voltage over a 24 hour period for such conventional adjustment was about 4.5 per cell, nearly 10 percent higher than the voltage requirement when the novel worm gear assemblies of this invention were employed.

What is desired to be secured by Letters Patent is:

1. In a mercury cell comprised of a cell body, a cell cover, anodes positioned within said cell body having anode posts extending through openings in said cell cover, and an anode adjustment means positioned on the top of said cell cover to adjust the distance between said anodes and said mercury, the improvement which comprises employing as said anode adjustment means an apparatus comprised of:

a. a central base member positioned on top of said cell cover substantially parallel to the sides of said cell body, b. at least two threaded upright posts having the bottom of each secured at spaced intervals to the top of said central base member, c. a worm gear adjuster secured to the top of each of said threaded posts, said worm gear adjuster being comprised of:

1. a worm gear housing secured to a central anode support member positioned above said central base member and spaced apart therefrom,
2. a worm gear having a threaded central opening adapted to rotate about the top of said threaded post,
3. a threaded worm adapted to mesh with threads on the circumference of said worm gear, said worm being positioned substantially parallel to said central anode support member,
4. a rod secured to and joining each of said worms,
5. a plurality of anode support arms secured at spaced intervals along said central anode support member,
6. a plurality of anodes secured to opposite sides of each of said anode arms, and
7. means for rotating said rod, whereby said worms are rotated, said worm gears are rotated, and said central anode support member, said anode arms and all of said anodes secured to said arms are raised or lowered in the direction of movement of said worm gear on said threaded posts.

2. The apparatus of claim 1 wherein said central base member is in the shape of an I-beam.

3. The apparatus of claim 1 wherein two threaded upright posts are secured to the top of said central base member.

4. The apparatus of claim 1 wherein at least one stiffening member is secured to the underside of said central anode support member, said stiffening member being anchored to said cell cover at its extremities.

5. The apparatus of claim 1 wherein a lifting member is secured to the top of said central base member, the upper portion of said lifting member extending through said central anode support member.

6. The apparatus of claim 1 wherein the number of said worm gear adjusters per cell is the sum of at least two of said adjusters for the first 10 feet of length of said central anode support member and at least one of said adjusters for each additional 10 feet of length.

* * * * *